US010607521B2

(12) United States Patent
Xi et al.

(10) Patent No.: US 10,607,521 B2
(45) Date of Patent: Mar. 31, 2020

(54) EMISSION CONTROLLER, CONTROL METHOD THEREOF AND DISPLAY DEVICE

(71) Applicant: Shanghai Tianma AM-OLED Co., Ltd., Shanghai (CN)

(72) Inventors: Kerui Xi, Shanghai (CN); Tingting Cui, Shanghai (CN); Feng Qin, Shanghai (CN); Xingyao Zhou, Shanghai (CN); Boquan Lin, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 20 days.

(21) Appl. No.: 16/198,963

(22) Filed: Nov. 23, 2018

(65) Prior Publication Data

US 2019/0295450 A1 Sep. 26, 2019

(30) Foreign Application Priority Data

Mar. 23, 2018 (CN) ..... 2018 1 0245825

(51) Int. Cl.
*G09G 3/20* (2006.01)

(52) U.S. Cl.
CPC ..... *G09G 3/20* (2013.01); *G09G 2300/0426* (2013.01); *G09G 2310/08* (2013.01); *G09G 2320/0233* (2013.01); *G09G 2320/0626* (2013.01)

(58) Field of Classification Search
CPC ..... G09G 3/20; G09G 2300/0426; G09G 2310/08; G09G 2320/0233; G09G 2320/0626
See application file for complete search history.

(56) References Cited

U.S. PATENT DOCUMENTS

| | | | | |
|---|---|---|---|---|
| 10,311,781 | B2 * | 6/2019 | Lee | G09G 3/3233 |
| 10,453,386 | B2 * | 10/2019 | Jang | G09G 3/3674 |
| 2012/0081409 | A1 * | 4/2012 | Chung | G09G 3/3266 345/690 |
| 2014/0055444 | A1 * | 2/2014 | Jang | G09G 3/3291 345/213 |
| 2017/0287395 | A1 | 10/2017 | Jang | |

FOREIGN PATENT DOCUMENTS

| | | |
|---|---|---|
| CN | 102592539 A | 7/2012 |
| CN | 104464605 A | 3/2015 |

* cited by examiner

*Primary Examiner* — Stephen G Sherman
(74) *Attorney, Agent, or Firm* — Tarolli, Sundheim, Covell & Tummino LLP

(57) ABSTRACT

The embodiments of the present disclosure provide an emission controller, a control method thereof and a display device, capable of preventing luminance of sub-pixels from deviating from its standard value and improving display quality. The emission controller includes a plurality of emission control circuits each including: a first processing module configured to receive a first voltage signal, provide a first signal to a first node and a second signal to a second node; a second processing module configured to provide a third signal to a third node; a third processing module configured to receive a second voltage signal and provide a fourth signal to the first and third nodes; a fourth processing module configured to pull down signal at the first node; and a gating module configured to receive the first voltage signal and the second voltage signal and provide an emission control signal to the emission control signal terminal.

20 Claims, 7 Drawing Sheets

EMISSION CONTROLLER, CONTROL METHOD THEREOF AND DISPLAY DEVICE

CROSS-REFERENCE TO RELATED APPLICATIONS

The present application claims priority to Chinese Patent Application No. 201810245825.8, filed on Mar. 23, 2018, the content of which is incorporated herein by reference in its entirety.

TECHNICAL FIELD

The present disclosure relates to the field of display technologies, and particularly, to an emission controller, a control method thereof and a display device.

BACKGROUND

A display device includes a plurality of sub-pixels on a display panel and an emission controller for driving the sub-pixels to emit light. The emission controller includes a plurality of cascaded emission control circuits each having an output terminal connected to a line of sub-pixels. The plurality of emission controllers output emission control signals in sequence, causing the sub-pixels receiving the emission control signals to emit light. However, when using the emission controllers in the prior art or during a process in which the emission controllers control the sub-pixels to emit light, the displayed pictures may be adversely impacted, which degrades the display performance.

SUMMARY

In view of the above, the embodiments of the present disclosure provide an emission controller, a control method thereof and a display device, capable of preventing luminance of sub-pixels from deviating from its standard value, thereby improving display quality.

In a first aspect, an embodiment of the present disclosure provides an emission controller which includes a plurality of cascaded emission control circuits outputting emission control signals in sequence. Each emission control circuit includes: a first processing module electrically connected to a first voltage signal terminal, a start signal terminal and a first control signal terminal, and configured to receive a first voltage signal, and provide a first signal to a first node and a second signal to a second node in response to a start signal and a first control signal a second processing module electrically connected to a second control signal terminal and configured to provide a third signal to a third node in response to a second control signal and the second signal; a third processing module electrically connected to a second voltage signal terminal and configured to receive a second voltage signal and provide a fourth signal to the first node and the third node, the second voltage signal having a higher voltage value than the first voltage signal; a fourth processing module electrically connected to a third control signal terminal and configured to pull down a signal at the first node in response to a third control signal; and a gating module electrically connected to the first voltage signal terminal, the second voltage signal terminal and an emission control signal terminal, and configured to receive the first voltage signal and the second voltage signal and provide an emission control signal to the emission control signal terminal in response to the third signal and the fourth signal. Among the plurality of cascaded emission control circuits, the first control signal terminal of a (3n+1)-th emission control circuit and the second control signal terminal of a (3n+3)-th emission control circuit are each electrically connected to a first clock signal line, the second control signal terminal of the (3n+1)-th emission control circuit and the first control signal terminal of a (3n+2)-th emission control circuit are each electrically connected to a second clock signal line, and the second control signal terminal of the (3n+2)-th emission control circuit and the first control signal terminal of the (3n+3)-th emission control circuit are each electrically connected to a third clock signal line, where n is an integer greater than or equal to 0.

In a second aspect, an embodiment of the present disclosure provides a control method for an emission controller, applied in the emission controller according to the first aspect. The control method includes: outputting emission control signals in sequence from each of the plurality of cascaded emission control circuits; and providing low-level signals in sequence at a first clock signal line, a second clock signal line and a third clock signal line. A process of outputting emission control signals in sequence from each of the plurality of cascaded emission control circuits comprises:

in a first period, providing a high-level signal at the start signal terminal; receiving, by the first processing module, the first voltage signal; receiving, by the first control signal terminal, a low-level signal provided at the clock signal line connected to the first control signal terminal; providing the first signal to the first node and the second signal to the second node in response to the low-level signal received at the first control signal terminal and the high-level signal provided at the start signal terminal; outputting, by the emission control signal terminal, a low-level signal, in a second period, receiving, by the second control signal terminal, a low-level signal provided at the clock signal line connected to the second control signal terminal; providing, by the second processing module, the third signal to the third node in response to the low-level signal received at the second control signal terminal; receiving, by the third processing module, the second voltage signal, and providing the fourth signal to the first node; receiving, by the gating module, the first voltage signal and the second voltage signal, and providing a high-level signal to the emission control signal terminal in response to the third signal and the fourth signal, wherein a voltage value of the second voltage signal is greater than a voltage value of the first voltage signal, and in a third period, pulling down, by the fourth processing module, the signal at the first node in response to a low-level signal received at the third control signal terminal; receiving, by the gating module, the first voltage signal and the second voltage signal, and providing a high-level signal to the emission control signal terminal in response to the third signal and the fourth signal.

In a third aspect, an embodiment of the present disclosure provides a display device which includes the emission controller according to the first aspect.

BRIEF DESCRIPTION OF DRAWINGS

In order to clearly illustrate technical solutions of embodiments of the present disclosure, the accompanying drawings used in the embodiments or the prior art are briefly introduced hereinafter. These drawings merely illustrate some embodiments of the present disclosure. On the basis of these drawings, those skilled in the art can also obtain other drawings without paying any creative effort.

DESCRIPTION OF EMBODIMENTS

In order to better understand technical solutions of the present disclosure, the embodiments of the present disclosure are described in details with reference to the drawings.

It should be clear that the described embodiments are merely part of the embodiments of the present disclosure rather than all of the embodiments. All other embodiments obtained by those skilled in the art without paying creative labor shall fall into the protection scope of the present disclosure.

The terms used in the embodiments of the present disclosure are merely for the purpose of describing specific embodiments, rather than limiting the present disclosure. The singular form "a", "an", "the" and "said" used in the embodiments and claims shall be interpreted as also including the plural form, unless indicated otherwise in the context.

It should be understood that, the term "and/or" is used in the present disclosure merely to describe relations between associated objects, and thus includes three types of relations. That is, A and/or B can represents: (a) A exists alone; (b) A and B exist at the same time; or (c) B exists alone. In addition, the character "/" generally indicates "or".

It should be understood that, although expressions "first", "second", "third" etc. are used to describe processing modules, they shall not be interpreted as limiting the processing modules. These expressions are merely used to distinguish among the processing modules. For example, without departing from the scope of the present disclosure, a first processing module also can be referred as a second processing module, and vice versa.

In order to allow a better understanding of the technical solutions according to the embodiments of the present disclosure, a structure of a display device according to an embodiment of the present disclosure will be described in detail first.

Figure 1:
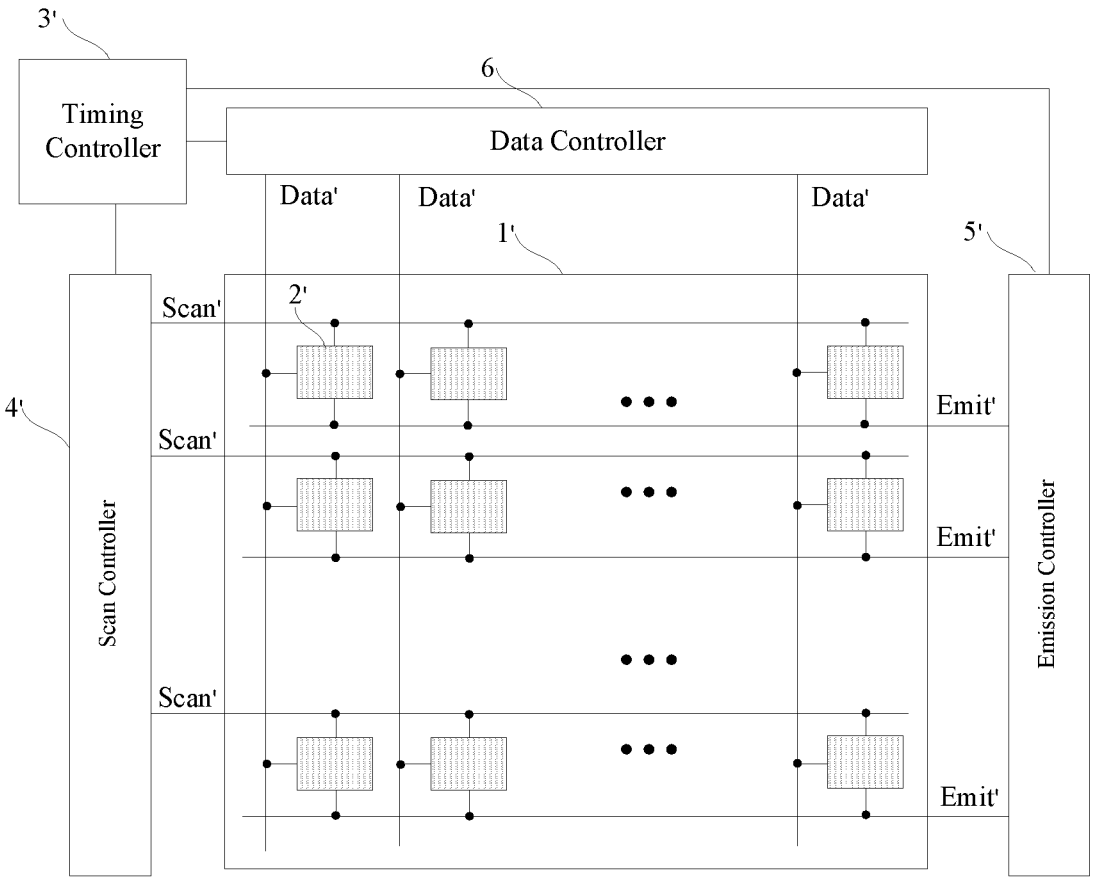
FIG. 1 is a schematic diagram showing a structure of a display device in the prior art.

As shown in FIG. 1, which is a schematic diagram showing a structure of a display device in the prior art, the display device includes a display panel 1' on which a plurality of sub-pixels 2' are arranged in m rows by n columns. The display device also includes a timing controller 3', a scan controller 4', an emission controller 5' and a data controller 6'. Here, the scan controller 4' has m output terminals each connected to a row of sub-pixels 2' via a scan line Scan'. The emission controller 5' has m output terminals each connected to a row of sub-pixels 2' via an emission control line Emit'. The data controller 6' has n output terminals each connected to a row of sub-pixels 2' via a data line Data'. The timing controller 3' is connected to the scan controller 4', the emission controller 5' and the data controller 6', for providing them with their respective driving signals.

In particular, the timing controller 3' generates a first driving signal, a second driving signal and a third driving signal in response to a received control signal. The scan controller 4' generates a scan signal in response to a first control signal. The scan signal is applied to the $1^{st}$ to m-th row of sub-pixels 2' in sequence via the m scan lines Scan'. The data controller 6' generates a data signal in response to a second control signal. The data signal is applied to the $1^{st}$ to n-th row of sub-pixels 2' in sequence via the n data lines Data'. The emission controller 5' generates an emission control signal in response to a third control signal. The emission control signal is applied to the $1^{st}$ to m-th row of sub-pixels 2' in sequence via the m emission control lines. When the i-th row of sub-pixels 2' receives the emission control signal, they emit light based on the data signal that has been applied in advance, where i is an integer from 1 to m.

Figure 2:
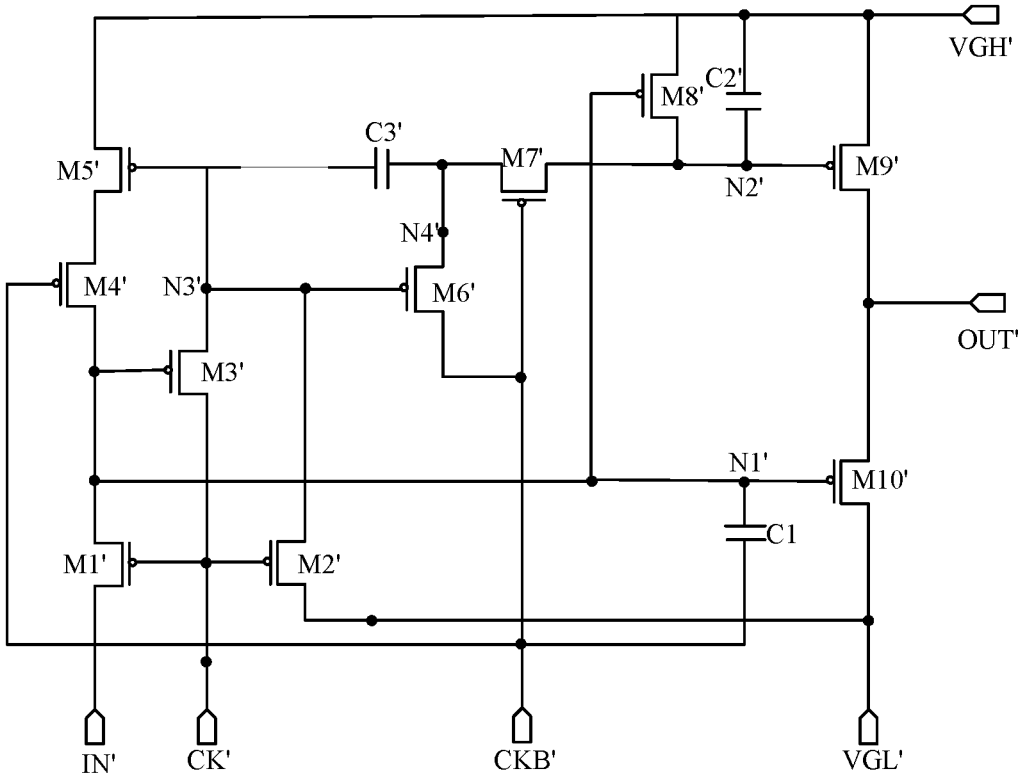
FIG. 2 is a schematic diagram showing a structure of an emission control circuit in the prior art.

Here, the above emission controller 5' may include m cascaded emission control circuits each having an output terminal connected to an emission control line Emit'. Conventionally, as shown in FIG. 2, which is a schematic diagram showing a structure of an emission control circuit in the prior art, the emission control circuit includes first to tenth Thin Film Transistors (TFTs) M1'~M10', first to third capacitors C1'~C3', a first signal terminal VGH', a second signal terminal VGL', a start signal terminal IN', a first control signal terminal CK', a second control signal terminal CKB' and an emission control signal terminal OUT'. In two neighboring cascaded emission control circuits, the emission control signal terminal OUT' of the preceding emission control circuit is connected to the start signal terminal IN' of the following emission control circuit (not shown).

Figure 3:
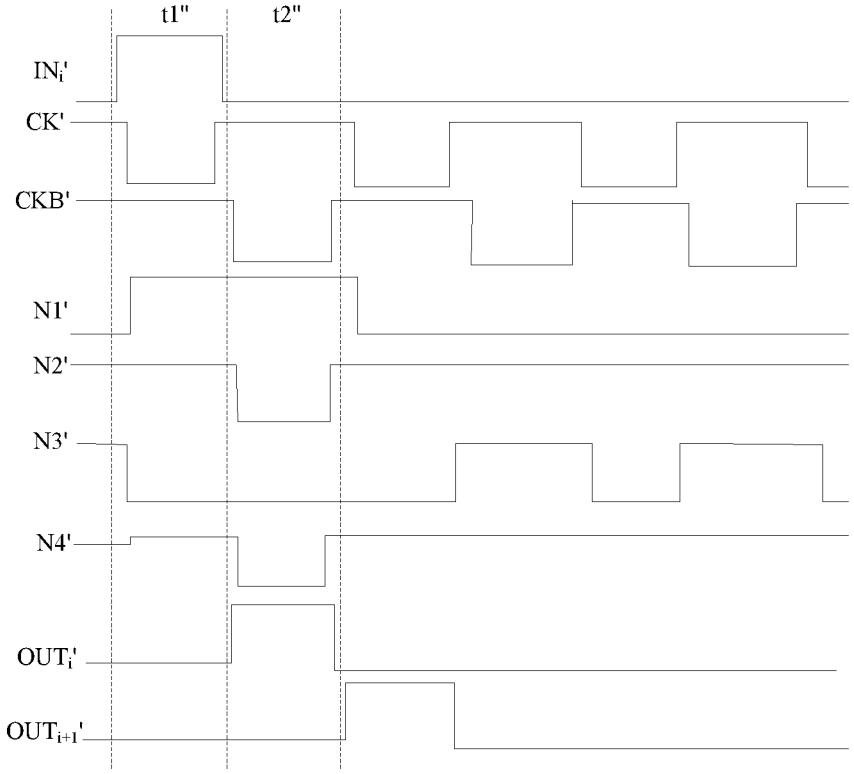
FIG. 3 is a signal timing sequence diagram corresponding to FIG. 2.

FIG. 3, which a signal timing sequence diagram corresponding to FIG. 2. With the connectivity between various structures in the emission control circuit, in response to the control signals provided at the first control signal terminal CK' and the second control signal terminal CKB', as shown in FIG. 3, for one of the emission control circuits, in a first period t1", a high-level signal is provided at the start signal terminal IN', a low-level signal is provided at the first control signal terminal CK', a high-level signal is provided at the second control signal terminal CKB', and the emission control signal terminal OUT' is maintained at a low level in response to the signals provided at the first control signal terminal CK' and the second control signal terminal CKB'. In a second period t2", a low-level signal is provided at the start signal terminal IN', a high-level signal is provided at the first control signal terminal CK', a low-level signal is provided at the second control signal terminal CKB', and a high-level signal is outputted at the emission control signal terminal OUT' in response to the signals provided at the first control signal terminal CK' and the second control signal terminal CKB'.

It can be seen from above that, in the emission control circuit, the high-level signal can only be outputted at the emission control signal terminal OUT' in the next period after the high-level signal is provided at the start signal terminal IN'. Since the high-level signal provided at the start signal terminal IN' in the emission control circuit is a high-level signal outputted from the previous emission control circuit, the high-level signals outputted from the two neighboring emission control circuits do not overlap. In this driving scheme, for an i-th emission control circuit and an (i+1)-th emission control circuit, when there is a large time gap between the high-level signals outputted from these two emission control circuits due to e.g., signal delay, an (i+1)-th row of sub-pixels will emit light in response to a low-level emission control signal outputted from the (i+1)-th emission control circuit within the time gap. As the data signal for the (i+1)-th row of sub-pixels has not been fully received in this time gap, the luminance of the (i+1)-th row of sub-pixels will deviate from a standard value, which degrades the quality of the displayed picture.

Figure 4:
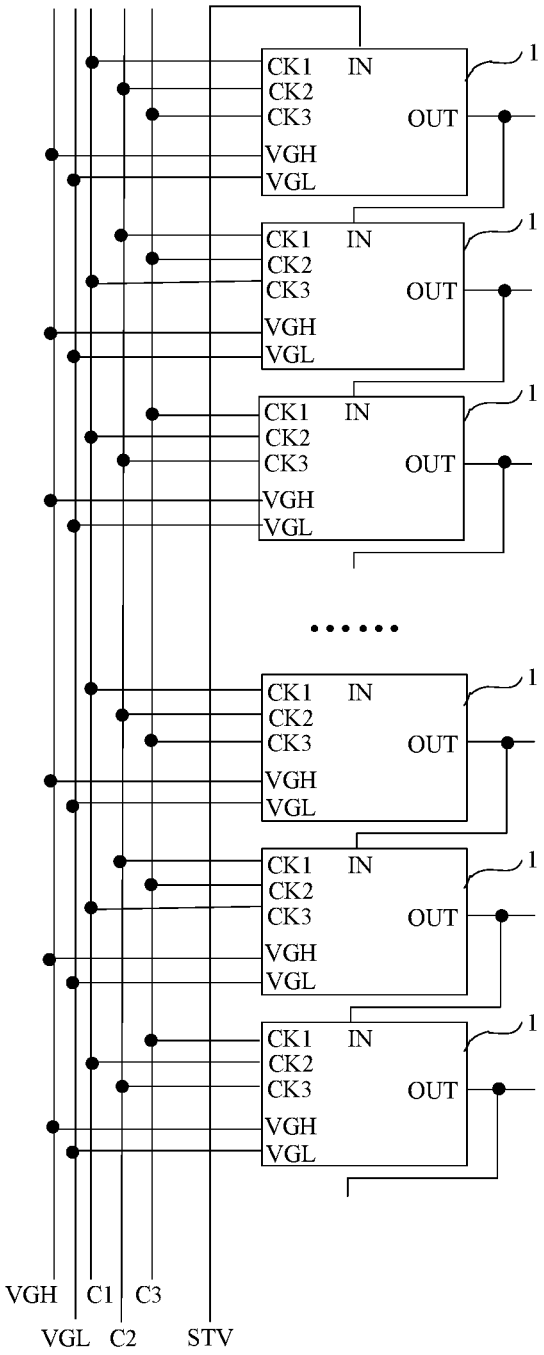
FIG. 4 is a schematic diagram showing a structure of an emission controller according to an embodiment of the present disclosure.

In view of this, an emission controller is provided according to an embodiment of the present disclosure. As shown in FIG. 4, which is a schematic diagram showing a structure of an emission controller according to an embodiment of the present disclosure, the emission controller includes a plurality of cascaded emission control circuits 1 outputting emission control signals in sequence.

Figure 5:
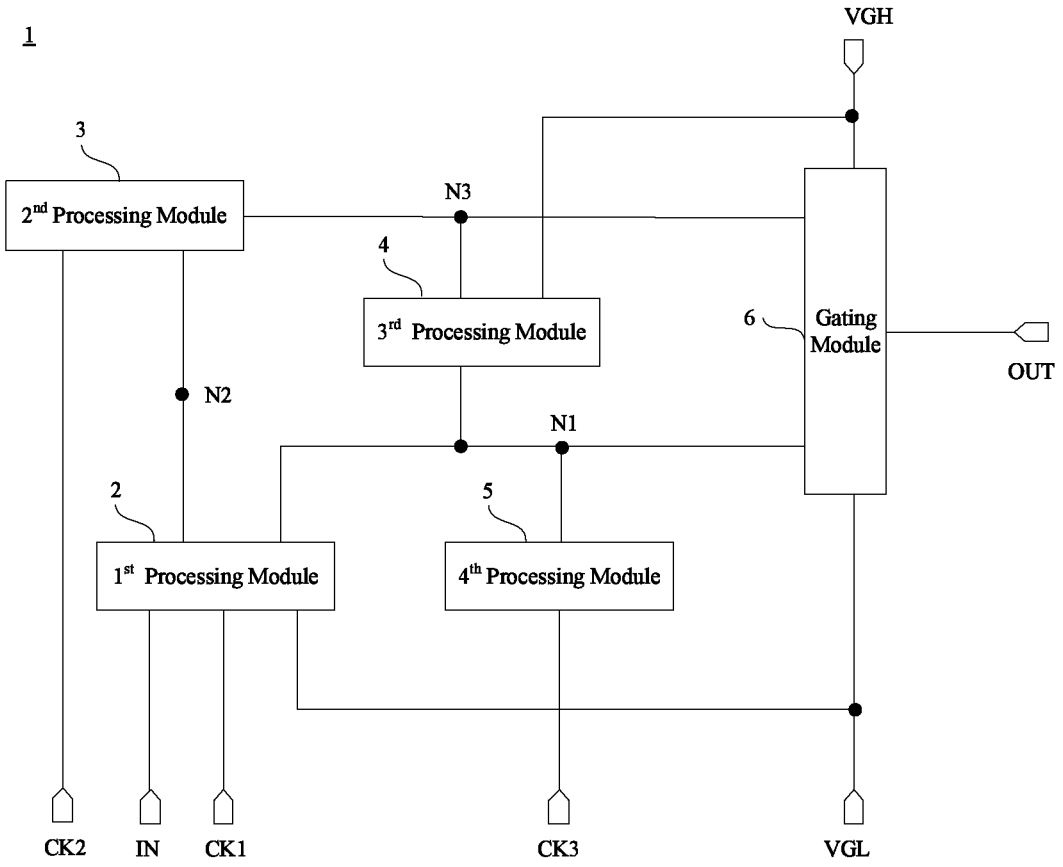
FIG. 5 is a schematic diagram showing a structure of an emission control circuit according to an embodiment of the present disclosure.

Referring to FIG. 5, which is a schematic diagram showing a structure of an emission control circuit according to an embodiment of the present disclosure, each emission control circuit 1 includes a first processing module 2, a second processing module 3, a third processing module 4, a fourth processing module 5 and a gating module 6.

The first processing module 2 is electrically connected to a first voltage signal terminal VGL, a start signal terminal IN and a first control signal terminal CK1, and configured to receive a first voltage signal and provide a first signal to a first node N1 and a second signal to a second node N2 in response to a start signal and a first control signal. The second processing module 3 is electrically connected to a second control signal terminal CK2 and configured to provide a third signal to a third node N3 in response to a second control signal and the second signal. The third processing module 4 is electrically connected to a second voltage signal terminal VGH, and configured to receive a second voltage signal and provide a fourth signal to the first node N1 and the third node N3. A voltage value of the second voltage signal is higher than a voltage value of the first voltage signal. The fourth processing module 5 is electrically connected to a third control signal terminal CK3, and configured to pull down a signal at the first node N1 in response to a third control signal. The gating module 6 is electrically connected to the first voltage signal terminal VGL, the second voltage signal terminal VGH and an emission control signal terminal OUT, and configured to receive the first voltage signal and the second voltage signal and provide an emission control signal to the emission control signal terminal OUT in response to the third signal and the fourth signal.

Referring again to FIG. 4, among the plurality of cascaded emission control circuits 1 in the emission controller, the first control signal terminal CK1 of a (3n+1)-th emission control circuit 1 and the second control signal terminal CK2 of a (3n+3)-th emission control circuit 1 are each electrically connected to a first clock signal line C1. The second control signal terminal CK2 of the (3n+1)-th emission control circuit 1 and the first control signal terminal CK1 of a (3n+2)-th emission control circuit 1 are each electrically connected to a second clock signal line C2. The second control signal terminal CK2 of the (3n+2)-th emission control circuit 1 and the first control signal terminal CK1 of the (3n+3)-th emission control circuit 1 are each connected to a third clock signal line C3, where n is an integer larger than or equal to 0.

Figure 6:
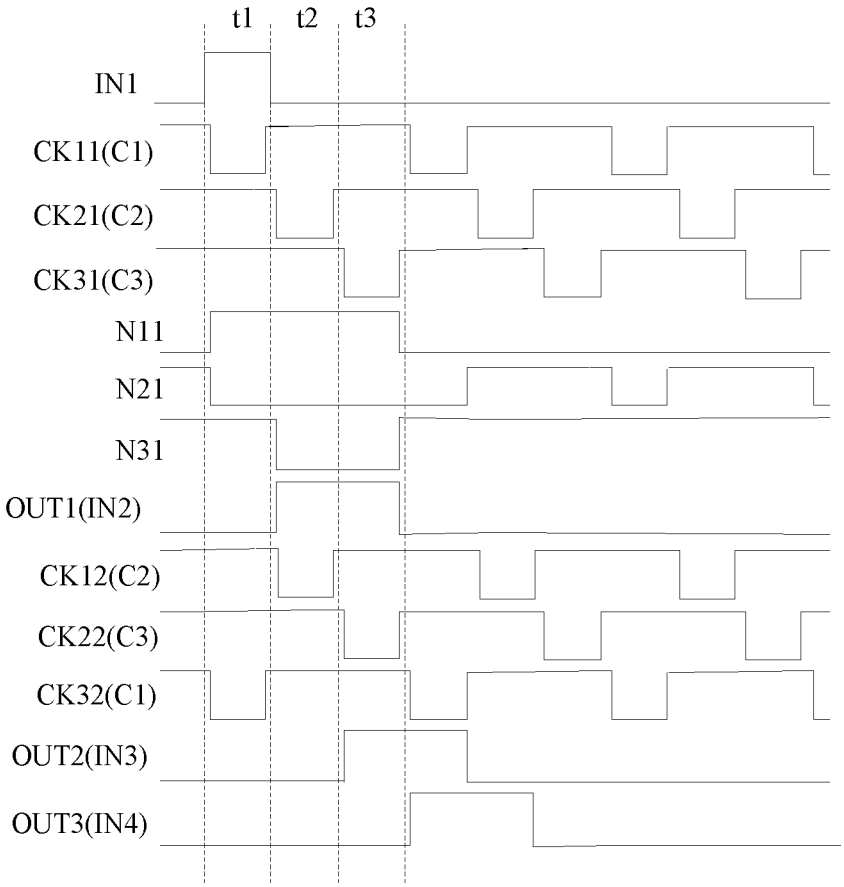
FIG. 6 is a signal timing sequence diagram corresponding to FIG. 5.

FIG. 6, is a timing sequence diagram corresponding to FIG. 5. A method for driving an emission control circuit 1 will be explained below with reference to FIG. 6, where the $1^{st}$ and $2^{nd}$ emission control circuits 1 of the plurality of cascaded emission control circuits 1 are taken as examples, when the emission control signal terminal OUT of the $1^{st}$ emission control circuit 1 is connected to the start signal terminal IN of the $2^{nd}$ emission control circuit 1.

The operation process of each emission control circuit may include three periods. In a first period t1 of operation process of the $1^{st}$ emission control circuit 1, a low-level signal is provided at the first clock signal line C1, a high-level signal is provided at the second clock signal line C2, and a high-level signal is provided at the third clock signal line C3. A high-level signal is provided at the start signal terminal IN1 (the signal provided at the start signal terminal IN1 of the $1^{st}$ emission control circuit 1 is designated as STV1 in FIG. 6); the first processing module 2 receives the first voltage signal and provides the high-level first signal to the first node N1 (the signal received at the first node N1 of the $1^{st}$ emission control circuit 1 is designated as N11 in FIG. 6) and the low-level second signal to the second node N2 (the signal received at the second node N2 of the $1^{st}$ emission control circuit 1 is designated as N21 in FIG. 6), in response to the low-level signal provided by the first clock line C1 and received at the first control signal terminal CK1 (the signal received at the first control signal terminal CK1 of the $1^{st}$ emission control circuit 1 is designated as CK11 in FIG. 6) and the high-level signal provided at the start signal terminal IN; and the emission control signal terminal OUT is maintained to output a low-level signal provided by the first voltage signal terminal VGL (the signal outputted from the emission control signal terminal OUT of the $1^{st}$ emission control circuit 1 is designated as OUT1 in FIG. 6).

In a second period t2 of operation process of the $1^{st}$ emission control circuit 1, a high-level signal is provided at the first clock signal line C1, a low-level signal is provided at the second clock signal line C2, and a high-level signal is provided at the third clock signal line C3. The second processing module 3 provides the low-level third signal to the third node N3 (the signal received at the third node N3 of the $1^{st}$ emission control circuit 1 is designated as N31 in FIG. 6) in response to the low-level signal provided by the second clock signal line C2 and received at the second control signal terminal CK2 (the signal received at the second control signal terminal CK2 of the $1^{st}$ emission control circuit 1 is designated as CK21 in FIG. 6). The third processing module 4 receives the second voltage signal and provides the high-level fourth signal to the first node N1, where the voltage value of the second voltage signal is higher than the voltage value of the first voltage signal. The gating module 6 receives the first voltage signal and the second voltage signal, and causes the emission control signal terminal OUT to output a high-level signal provided by the second voltage signal terminal VGH in response to the low-level third signal and the high-level fourth signal.

In this period, the high-level signal outputted from the emission control signal terminal OUT of the $1^{st}$ emission control circuit 1 is received at the start signal terminal IN of the $2^{nd}$ emission control circuit 1. Similarly to the first period t1 of the operation process of the $1^{st}$ emission control circuit 1, the low-level signal provided at the second clock signal line C2 is received at the first control signal terminal CK1 of the $2^{nd}$ emission control circuit 1. The $2^{nd}$ emission control circuit 1 causes the emission control signal terminal OUT to output the low-level signal provided by the first voltage signal terminal VGL (the signal outputted from the emission control signal terminal OUT of the $2^{nd}$ emission control circuit 1 is designated as OUT2 in FIG. 6) in response to the low-level signal received at the first control signal terminal CK1 and the high-level signal received at the start signal terminal IN. That is, the second period t2 of operation process of the $1^{st}$ emission control circuit 1 corresponds to the first period t1 of the $2^{nd}$ emission control circuit 1.

In a third period t3 of operation process of the $1^{st}$ emission control circuit 1, a high-level signal is provided at the first clock signal line C1, a high-level signal is provided at the second clock signal line C2, and a low-level signal is provided at the third clock signal line C3. A low-level signal is received at the third control signal terminal CK3 (the signal received at the third control signal terminal CK3 of the $1^{st}$ emission control circuit 1 is designated as CK31 in FIG. 6). The fourth processing module 5 pulls down the high-level fourth signal at the first node N1 in response to the low-level signal received at the third control signal terminal CK3, during which the fourth signal at the first node N1 is still at a high level after being pulled down. The third node N3 is maintained at the low-level third signal. The gating module 6 receives the first voltage signal and the second voltage signal, and causes the emission control signal terminal OUT to continuously output the high-level signal provided by the second voltage signal terminal VGH in response to the third signal at the third node N3 and the pulled down high-level signal at the first node N1.

In this period, the high-level signal outputted from the emission control signal terminal OUT of the $1^{st}$ emission control circuit 1 is received at the start signal terminal IN of the $2^{nd}$ emission control circuit 1. Similarly to the second period t2 of the operation process of the $1^{st}$ emission control circuit, the low-level signal provided at the third clock signal line C3 is received at the second control signal terminal CK2 of the 2nd emission control circuit 1. The $2^{nd}$ emission control circuit 1 causes the emission control signal terminal OUT to output the high-level signal provided by the second voltage signal terminal VGH in response to the low-level signal received at the second control signal terminal CK2 and the high-level signal received at the start signal terminal IN. That is, the third period t3 of operation process of the $1^{st}$ emission control circuit 1 corresponds to the second period t2 of the $2^{nd}$ emission control circuit 1.

That is, in the third period t3 of operation process of the $1^{st}$ emission control circuit 1, the $1^{st}$ emission control circuit 1 and the $2^{nd}$ emission control circuit 1 both output high-level signals. These two signals overlap at the same time. Similarly, in the third period t3 of operation process of the $2^{nd}$ emission control circuit 1, the 2nd emission control circuit 1 and the $3^{rd}$ emission control circuit 1 both output high-level signals, and so on. In the third period t3 of operation process of the (i−1)-th emission control circuit 1, both the (i−1)-th emission control circuit 1 and the i-th emission control circuit 1 output high-level signals.

It can be seen from above that, when compared with the conventional scheme in which an emission control circuit is driven by two control signal terminals, in the emission controller according to the embodiment of the present disclosure, each emission control circuit 1 includes three control signal terminals: a first control signal terminal CK1, a second control signal terminal CK2 and a third control signal terminal CK3. With the connectivity among the respective modules and the three control signal terminals in each emission control circuit 1, and with the connectivity among the three control signal terminals in each emission control circuit 1 in the emission controller and a first clock signal line C1, a second clock signal line C2 and a third clock signal line C3, the emission controller can make the high-level signal outputted from the emission control signal terminal OUT and the high-level signal received at the start signal terminal IN overlap each other. Accordingly, with the solutions according to the embodiments of the present disclosure, even if there is a signal delay problem, a time gap between high-level signals outputted from two neighboring emission control circuits 1 can be avoided, so as to prevent sub-pixels from emitting light in response to data signals that have not been fully written, which would otherwise cause their luminance to deviate from standard values. In this way, the display quality can be improved.

Referring again to FIG. 4, among the plurality of cascaded emission control circuits 1, the third control signal terminal CK3 of the (3n+2)-th emission control circuit 1 is electrically connected to the first clock signal line C1, the third control signal terminal CK3 of the (3n+3)-th emission control circuit 1 is electrically connected to the second clock signal line C2, and the third control signal terminal CK3 of the (3n+1)-th emission control circuit 1 is electrically connected to the third clock signal line C3.

Since the first clock signal line C1, the second clock signal line C2 and the third clock signal line C3 provides low-level signals in sequence, with the connectivity between the third control signal terminal CK3 of each emission control circuit 1 and the first clock signal line C1, the second clock signal line C2 and the third clock signal line C3, in the third period of operation process of each emission control circuit 1, the third control signal terminal CK3 of the emission control circuit 1 will receives a low-level signal provided by its corresponding clock signal line, which guarantees that the fourth processing module 5 of the emission control circuit 1 can pull down the signal at the first node N1 in response to the low-level signal.

Optionally, referring again to FIG. 4, among the plurality of cascaded emission control circuits 1, the start signal terminal IN of the $1^{st}$ emission control circuit 1 is electrically connected to a frame start signal line STV Among any two neighboring emission control circuits 1, the emission control signal terminal OUT of the first emission controller is electrically connected to the start signal terminal IN of the second emission controller.

As described above in connection with the method for driving the emission control circuit 1, when the high-level signal outputted from the emission control signal terminal OUT of an emission control circuit 1 serves as the high-level start signal received at the start signal terminal IN of the emission control circuit 1 at next stage, the high-level signals outputted and received by the emission control circuits 1 will overlap, i.e., the high-level signals outputted from two neighboring control circuits 1 will overlap.

Further, it is to be noted that, for the $1^{st}$ emission control circuit 1, if its start signal terminal IN provides the high-level signal only in the first period t1, it can be seen from the above description of the method for driving the emission control circuit 1 that the high-level signals outputted from any two subsequent neighboring control circuits 1 will overlap. However, in this case, the high-level signal provided at the start signal terminal IN of the $1^{st}$ emission control circuit 1 and the high-level signal outputted from the emission control signal terminal OUT of the $1^{st}$ emission control circuit 1 do not overlap.

However, since a high-level signal is received at the first control signal terminal CK1 of the 1st emission control circuit 1 in the second period t2, the first processing module 2 will not transmit the signal received at the start signal terminal IN1 to the first node N1, under control of the high-level signal. Hence, if a high-level signal is also received at the 1st emission control circuit 1 in the second period t2, the high-level signal will not affect the normal operation process of the circuit, and guarantees that the high-level signals outputted from any two subsequent neighboring control circuits 1 will overlap. In this case, the high-level signal provided at the start signal terminal IN of the 1st emission control circuit 1 and the high-level signal outputted from the emission control signal terminal OUT of the 1st emission control circuit 1 do not overlap.

Further, since the start signal terminal IN of the 1st emission control circuit 1 is connected to the frame start signal line STV, the signal received at the start signal terminal IN is controlled only by the signal outputted from the frame start signal line STV. The period in which the high-level signal is received at the start signal terminal IN can be extended simply by continuously transmitting the frame start signal line STV by the high-level signal.

Figure 7:
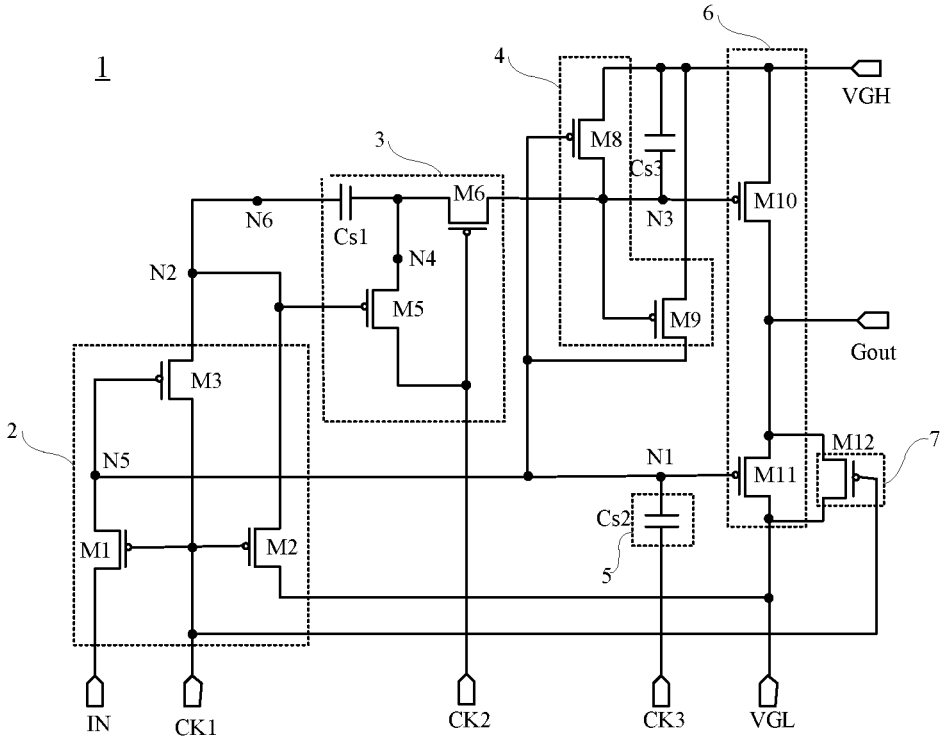
FIG. 7 is a schematic diagram showing another structure of an emission control circuit according to an embodiment of the present disclosure.

Optionally, as shown in FIG. 7, which is a schematic diagram showing another structure of an emission control circuit according to an embodiment of the present disclosure, the first processing module can include a first thin film transistor (TFT) M1, a second TFT M2 and a third TFT M3. The first to third TFTs M1-M3 can be P-type TFTs.

The first TFT M1 has its control electrode electrically connected to the first control signal terminal CK1, its first electrode electrically connected to the first node N1 and its second electrode electrically connected to the start signal terminal IN. The first TFT M1 controls the electrical connection between the start signal terminal IN and the first node N1 in response to the applied first control signal.

The second TFT M2 has its control electrode electrically connected to the first control signal terminal CK1, its first electrode electrically connected to the second node N2 and its second electrode electrically connected to the first voltage signal terminal VGL. The second TFT M2 controls the electrical connection between the first voltage signal terminal VGL and the second node N2 in response to the applied first control signal.

The third TFT M3 has its control electrode electrically connected to the first electrode of the first TFT M1, its first electrode electrically connected to the second node N2 and its second electrode electrically connected to the first control signal terminal CK1. The third TFT M3 controls the electrical connection between the first control signal terminal CK1 and the second node N2 in response to the signal applied to the first node N1.

Figure 8:
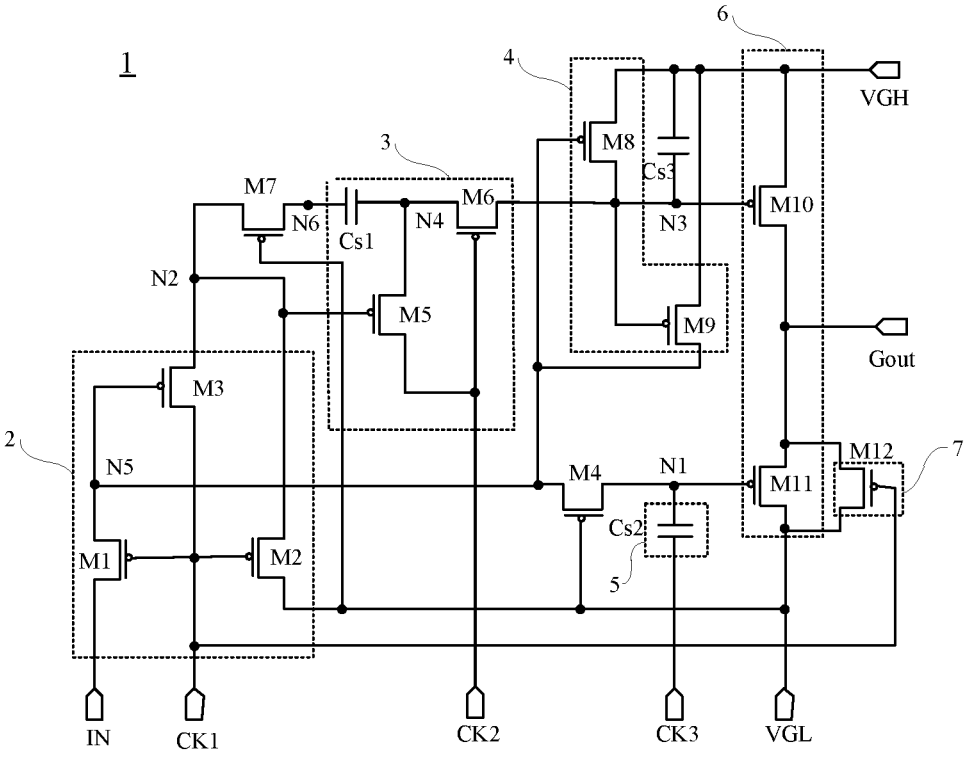
FIG. 8 is a schematic diagram showing yet another structure of an emission control circuit according to an embodiment of the present disclosure.

Further, as shown in FIG. 8, which is a schematic diagram showing yet another structure of an emission control circuit according to an embodiment of the present disclosure, the first electrode (the fifth node N5) of the first TFT M1 is electrically connected to the first node N1 via a fourth TFT M4 which is maintained being switched-on. For example, the fourth TFT M4 may have its control electrode electrically connected to the first voltage signal terminal VGL, its first electrode electrically connected to the first TFT M1, and its second electrode connected to the first node N1. Since the switched-on state of the fourth TFT M4 is controlled by the first voltage signal and the first voltage signal provided by the first voltage signal terminal VGL is fixed at the low level, the fourth TFT M4 can be maintained in a switched-on state.

In a practical application of the emission control circuit 1, the signal potential at the first node N1 will be affected by another structure connected with it, e.g., the fourth processing module 5, such that the signal at the first node N1 may contain glitches instead of being smooth. If there is only one direct line connecting the first node N1 and the fifth node N5, the signal at the fifth node N5 will be affected by the signal at the first node N1 and thus be unstable, which may in turn affect the operation states of the third TFT M3 and the eighth TFT M8. If the fourth TFT M4 which is maintained being switched-on is provided between the first node N1 and the fifth node N5, the switched-on fourth TFT M4 can be equivalent to a resistor having a certain resistance and having functions of current limitation and voltage division, such that the impact of the first node N1 on the signal at the fifth node N5 can be reduced to some extent. In this way, the third TFT M3 and the eighth TFT M8 can be maintained being switched-on or off correctly under control of the signal at the fifth node N5, thereby improving the operation stability of the circuit.

On the other hand, when a high-level signal is provided at the start signal terminal IN, the potential at the first node N1 will be pulled down by its bootstrap capacitance, such that a voltage drop of the first TFT M1 is too great to operate normally. When the fourth TFT M4 which is on is provided between the first node N1 and the first node of the first TFT M1, the fourth TFT M4 can have a function of voltage division, so as to reduce the voltage drop of the first TFT M1, thereby protecting the first TFT M1 and improving the operation stability of the first TFT M1.

Optionally, referring to FIG. 7, the second processing module 3 includes a first capacitor Cs1, a fifth TFT M5 and a sixth TFT M6. The fifth TFT M5 and the sixth TFT M6 are P-type TFTs.

The first capacitor Cs1 has its first electrode electrically connected to the second node N2 and its second electrode (the fourth node N4). When the signal at the fourth node N4 is a low-level signal, the first capacitor, as a bootstrap capacitor, can make its level lower. In this way, when the sixth TFT M6 is switched-on, the lower level signal can be transmitted to the third node N3, so as to enhance the capability of the low-level signal at the third node N3 to drive the gating module 6. Therefore, it is possible to ensure that the gating module 6 will transmit the second voltage signal to the emission control signal terminal OUT under control of the low-level signal.

The fifth TFT M5 has its control electrode electrically connected to the second node N2, its first electrode electrically connected to the second electrode of the first capacitor Cs1, and its second electrode electrically connected to the second control signal terminal CK2. The fifth TFT M5 controls the electrical connection between the fourth node N4 and the second control signal terminal CK2 in response to the signal applied to the second node N2.

The sixth TFT M6 has its control electrode electrically connected to the second control signal terminal CK2, its first electrode electrically connected to the second electrode of the first capacitor Cs1, and its second electrode electrically connected to the third node N3. The sixth TFT M6 controls the electrical connection between the second electrode of the first capacitor, i.e., the fourth node N4, and the third node N3 in response to the applied second control signal.

Referring again to FIG. 8, the first electrode of the first capacitor Cs1 (the sixth node N6) is electrically connected to the second node N2 via a seventh TFT M7 which is maintained being switched-on. For example, the seventh TFT M7 has its control electrode electrically connected to the first voltage signal terminal VGL, its first electrode electrically connected to the second node N2, and its second electrode electrically connected to the sixth node N6. Since the switched-on state of the seventh TFT M7 is controlled by the first voltage signal which is fixed at the low level, the seventh TFT M7 can be maintained being switched-on. When the seventh TFT M7 which is maintained being switched-on is provided between the sixth node N6 and the second node N2, the switched-on seventh TFT M7 can be equivalent to a resistor having functions of current limitation and voltage division, such that the mutual impact between signals at the sixth node N6 and the second node N2 can be reduced to some extent, thereby improving the operation stability of the circuit.

Optionally, referring to FIG. 7, the third processing module 4 includes an eighth TFT M8 and a ninth TFT M9. The eighth TFT M8 and the ninth TFT M9 can be P-type TFTs.

The eighth TFT M8 has its control electrode electrically connected to the first node N1, its first electrode electrically connected to the second voltage signal terminal VGH, and its second electrode electrically connected to the third node N3. The eighth TFT M8 controls the electrical connection between the second voltage signal terminal VGH and the third node N3 in response to the signal applied to the first node N1.

The ninth TFT M9 has its control electrode electrically connected to the third node N3, its first electrode electrically connected to the second voltage signal terminal VGH, and its second electrode electrically connected to the first node N1. The ninth TFT M9 controls the electrical connection between the second voltage signal terminal CGH and the first node N1 in response to the signal applied to the third node N3.

When a low-level signal is applied to the third node N3, the gating module 6 transmits the high-level second voltage signal to the emission control signal terminal OUT in response to the low-level signal, causing the emission control signal terminal OUT to output a high-level signal. Since the control electrode of the ninth TFT M9 is electrically connected to the third node N3, in this period, the ninth TFT M9 is switched on in response to the low-level signal applied to the third node N3, so as to transmit the high-level second voltage signal provided at the second voltage signal terminal VGH to the first node N1, and thus maintain the signal at the first node N1 at the high level stably. In this way, it is possible to avoid affecting the high-level signal outputted from the emission control signal terminal OUT when the gating module 6 transmits the low-level voltage signal provided at the first voltage signal terminal VGL to the emission control signal terminal OUT.

Moreover, the ninth TFT M9 is switched on only when the signal at the third node N3 is at the low level. That is, the ninth TFT M9 transmits the second voltage signal to the first node N1 only when a high level is outputted from the emission control signal terminal OUT. When a low level is outputted from the emission control signal terminal OUT, the signal at the third node N3 is at the high level. At this time, the ninth TFT M9 is switched off and thus will not affect the potential of the signal at the first node N1.

Optionally, referring to FIG. 7, the fourth processing module 5 includes a second capacitor Cs2 having its first electrode electrically connected to the first node N1 and its second electrode electrically connected to the third control signal terminal CK3. When the signal received at the third control signal terminal CK3 is switched from the high level to the low level, the second capacitor Cs2 can pull down the potential of the signal at the first node N1. When the signal applied to the first node N1 is at the low level, by further pulling down the low-level signal, the capability of the low-level signal to drive the gating module 6 can be enhanced, so that the gating module 6 can transmit the first voltage signal to the emission control signal terminal. When the signal applied to the first node N1 is at the high level, the signal at the first node N1 is still a high-level signal after being pulled down.

Optionally, referring to FIG. 7, the gating module 6 includes a tenth TFT M10 and an eleventh TFT M11. The tenth TFT M10 and the eleventh TFT M11 can be P-type TFTs.

The tenth TFT M10 has its control electrode electrically connected to the third node N3, its first electrode electrically connected to the second control signal terminal CK2, and its second electrode electrically connected to the emission control signal terminal OUT. The tenth TFT M10 controls the electrical connection between the second control signal terminal CK2 and the emission control signal terminal OUT in response to the signal applied to the third node N3.

The eleventh TFT M11 has its control electrode electrically connected to the first node N1, its first electrode electrically connected to the emission control signal terminal OUT, and its second electrode electrically connected to the first voltage signal terminal VGL. The eleventh TFT M11 controls the electrical connection between the first voltage signal terminal VGL and the emission control signal terminal OUT in response to the signal applied to the first node N1.

Figure 9:
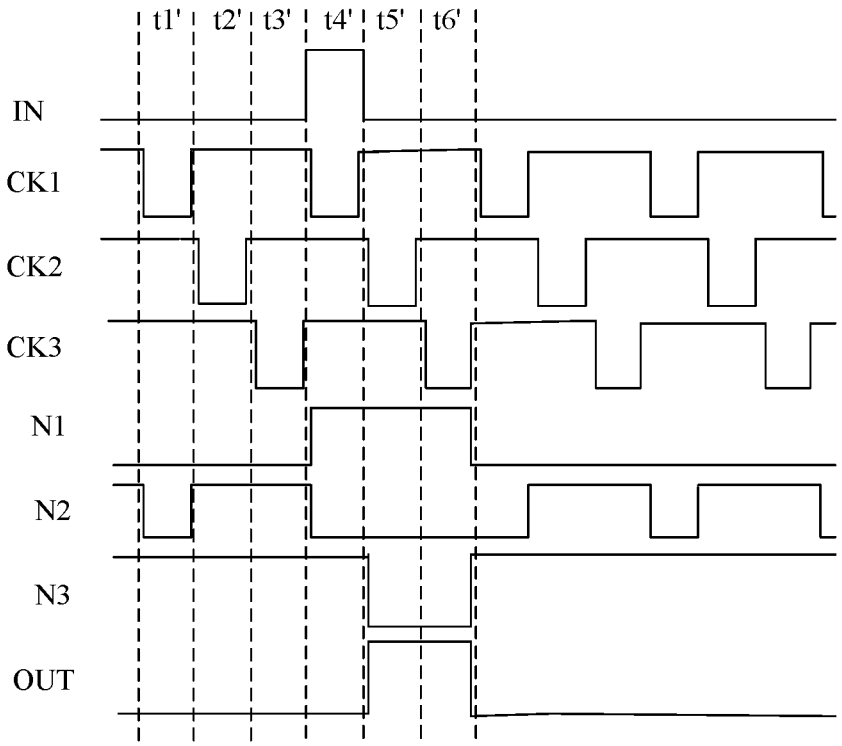
FIG. 9 is a signal timing sequence diagram corresponding to FIG. 7.

Referring to FIG. 9, which is a signal timing sequence diagram corresponding to FIG. 7, the operation process of the emission control circuit 1 shown in FIG. 7 will be described below, assuming that the first to eleventh TFT M1-M11 are P-type transistors.

In a first period t1', a low-level signal is provided at the start signal terminal IN, a low-level signal is received at the first control signal terminal CK1, a high-level signal is received at the second control signal terminal CK2, and a high-level signal is received at the third control signal terminal CK3. The low-level signal provided at the start signal terminal IN is transmitted to the first node N1 via the first TFT M1 which is switched-on, and the eleventh TFT M11 is switched on in response to the low-level signal applied to the first node N1. The low-level signal received at the first control signal terminal CK1 is transmitted to the second node N2 via the switched-on third TFT M3, the high-level second voltage signal is transmitted to the third node N3 via the switched-on eighth TFT M8, and the tenth TFT M10 is switched off in response to the high-level signal applied to the third node N3. In this period, the first voltage signal is transmitted to the emission control signal terminal OUT via the switched-on eleventh TFT M11, i.e., a low-level signal is outputted at the emission control signal terminal OUT.

In a second period t2', a low-level signal is provided at the start signal terminal IN, a high-level signal is received at the first control signal terminal CK1, a low-level signal is received at the second control signal terminal CK2, and a high-level signal is received at the third control signal terminal CK3. A low-level signal is maintained at the first node N1. The eleventh TFT M11 remains on. The high-level signal received at the first control signal terminal CK1 is transmitted to the second node N2 via the switched-on third TFT M3, the high-level second voltage signal is transmitted to the third node N3 via the switched-on eighth TFT M8, and the tenth TFT M10 is maintained being switched-off. In this period, a low-level signal continues to be outputted at the emission control signal terminal OUT.

In a third period t3', a low-level signal is provided at the start signal terminal IN, a high-level signal is received at the first control signal terminal CK1, a high-level signal is received at the second control signal terminal CK2, and a low-level signal is received at the third control signal terminal CK3. A low-level signal is maintained at the first node N1. The second capacitor Cs2 pulls down the voltage at the first node N1 in response to the low-level signal received at the third control signal terminal CK3, such that the eleventh TFT M11 is more fully switched-on in response to the pulled down low-level signal. The high-level signal received at the first control signal terminal CK1 is transmitted to the second node N2 via the switched-on third TFT M3, the high-level second voltage signal is transmitted to the third node N3 via the switched-on eighth TFT M8, and the tenth TFT M10 is maintained being switched-off. In this period, a low-level signal continues to be outputted at the emission control signal terminal OUT.

In a fourth period t4' (corresponding to the first period t1 in FIG. 6), a high-level signal is provided at the start signal terminal IN, a low-level signal is received at the first control signal terminal CK1, a high-level signal is received at the second control signal terminal CK2, and a high-level signal is received at the third control signal terminal CK3. The high-level signal provided at the start signal terminal IN is transmitted to the first node N1 via the first TFT M1 which is switched-on, and the eleventh TFT M11 is switched-off. The low-level signal at the first voltage signal terminal VGL is transmitted to the second node N2 via the second TFT M2 which is switched-on, the high-level signal is maintained at the third node N3, and the tenth TFT M10 is maintained being switched-off. In this period, a low-level signal continues to be outputted at the emission control signal terminal OUT.

In a fifth period t5' (corresponding to the second period t2 in FIG. 6), a high-level signal is provided at the start signal terminal IN (for the 1st emission control circuit 1 among the plurality of cascaded emission control circuits 1, a high-level or low-level signal can be provided at its start signal terminal IN in this period), a high-level signal is received at the first control signal terminal CK1, a low-level signal is received at the second control signal terminal CK2, and a high-level signal is received at the third control signal terminal CK3. A high-level signal is maintained at the first node N1. The eleventh TFT M11 remains being switched-off. The low-level signal received at the second control signal terminal CK2 is transmitted to the third node N3 via the fifth TFT M5 and the sixth TFT M6 which are switched-on, and the tenth TFT M10 is switched on. In this period, the second voltage signal is transmitted to the emission control signal terminal OUT via the tenth TFT M10 which is switched-on, i.e., a high-level signal is outputted at the emission control signal terminal OUT.

Moreover, in this period, the ninth TFT M9 is switched on in response to the low-level signal applied at the third node N3, and the second voltage signal is transmitted to the first node N1 via the ninth TFT M9 which is switched-on, such that a high-level signal is applied to the first node N1 stably. In turn, this ensures that the eleventh TFT M11 is switched-off during this period and prevents the first voltage signal from being transmitted to the emission control signal terminal OUT, thereby avoiding impact on the high-level signal outputted at the emission control signal terminal OUT.

In a sixth period t6' (corresponding to the second period t3 in FIG. 6), a low-level signal is provided at the start signal terminal IN, a high-level signal is received at the first control signal terminal CK1, a high-level signal is received at the second control signal terminal CK2, and a low-level signal is received at the third control signal terminal CK3. A high-level signal is maintained at the first node N1, a low-level signal is maintained at the second node N2, and a low-level signal is maintained at the third node N3. The tenth TFT M10 remains being switched-off. In this period, a high-level signal continues to be outputted at the emission control signal terminal OUT.

Further, referring again to FIG. 7, the emission control circuit 1 can further include a fifth processing module electrically connected to the first voltage signal terminal VGL, the first control signal terminal CK1 and the emission signal control terminal, and configured to receive the first voltage signal and maintain output of the first voltage signal to the emission signal control terminal in response to the first control signal.

In particular, in the first period t1' and the fourth period t4', a low-level signal is received at the first control signal terminal CK1, the eleventh TFT M11 is switched-on, and the low-level signal provided by the first voltage signal terminal VGL is outputted at the emission control signal terminal OUT. When the emission control circuit 1 further includes the fifth processing module 7, the fifth processing module 7 can transmit the first voltage signal to the emission control signal terminal in response to the low-level signal received at the first control signal terminal CK1, so as to pull down the signal outputted at the emission control signal terminal, and further guarantee that the low-level signal is outputted at the emission control signal terminal in these two periods.

Referring again to FIG. 7, the fifth processing module includes a twelfth TFT M12 which can be a P-type TFT. The twelfth TFT M12 has its control electrode electrically connected to the first control signal terminal CK1, its first electrode electrically connected to the emission control signal terminal OUT, and its second electrode electrically connected to the first voltage signal terminal VGL. The twelfth TFT M12 controls the electrical connection between the first voltage signal terminal VGL and the emission control signal terminal OUT in response to the signal applied to the first control signal terminal CK1.

Further, referring again to FIG. 7, the emission control circuit 1 can further include a storage capacitor Cs3 having its first electrode electrically connected to the second voltage signal terminal VGH and its second electrode electrically connected to the third node N3. The storage capacitor Cs3 stores signals and can stabilize, when a signal is maintained at the third node N3, the potential of the signal.

In particular, the first clock signal line C1, the second clock signal line C2 and the third clock signal line C3 output low-level signals in sequence. When one of the first clock signal line C1, the second clock signal line C2 and the third clock signal line C3 outputs a low-level signal, the other two each output a high-level signal. With the connectivity between the three control signal terminals and the three clock signal lines in each emission control circuit 1, the signal outputting scheme of the three clock signal lines can ensure that, in a particular period, only one of the control signal terminals of each emission control circuit 1 will receive a low-level signal, thereby guaranteeing the normal operation process of the emission control circuit 1.

According to an embodiment of the present disclosure, a control method for an emission controller is also provided. The control method is applied in the above emission controller.

The control method for the emission controller includes: outputting emission control signals in sequence from the plurality of cascaded emission control circuits.

Low-level signals are provided in sequence at a first clock signal line, a second clock signal line and a third clock signal line. A process of outputting emission control signals in sequence from the plurality of cascaded emission control circuits includes:

in a first period, a high-level signal is provided at the start signal terminal; the first processing module receives the first voltage signal, a low-level signal provided at the clock signal line connected to the first control signal terminal is received at the first control signal terminal, the first signal is provided to the first node and the second signal is provided to the second node in response to the low-level signal received at the first control signal terminal and the high-level signal provided at the start signal terminal, and the emission control signal terminal outputs a low-level signal;

in a second period, a low-level signal provided at the clock signal line connected to the second control signal terminal is received at the second control signal terminal, the second processing module provides the third signal to the third node in response to the low-level signal received at the second control signal terminal, the third processing module receives the second voltage signal and provide the fourth signal to the first node; the gating module receives the first voltage signal and the second voltage signal and provide a high-level signal to the emission control signal terminal in response to the third signal and the fourth signal, wherein a voltage value of the second voltage signal is greater than a voltage value of the first voltage signal; and in a third period, the fourth processing module pulls down the signal at the first node in response to a low-level signal received at the third control signal terminal; the gating module receives the first voltage signal and the second voltage signal and provide a high level signal to the emission control signal terminal in response to the third signal and the fourth signal.

The process of controlling the emission control circuit has been described in detail in connection with the above embodiment, and the details thereof will be omitted here.

When compared with the conventional solutions, the control method for the emission controller according to the embodiment of the present disclosure can make the high-level signal outputted from the emission control signal terminal and the high-level signal received at the start signal terminal overlap each other. Accordingly, even if there is a signal delay problem, a time gap between high-level signals outputted from two neighboring emission control circuits 1 can be avoided, so as to prevent sub-pixels from emitting light in response to data signals that have not been fully written, which would otherwise cause their luminance to deviate from standard values. In this way, the display quality can be improved.

Further, referring to FIG. 7, when the emission control circuit further includes a fifth processing module, the process in which each emission control circuit outputs the emission control signal further includes: in an initial time period (i.e., the first period in the above embodiment) and the first period, the fifth processing module receives the first voltage signal and maintains output of the first voltage signal to the emission signal control terminal in response to the first control signal.

In particular, in the first period and the fourth period (the first time period) of the initial time period, a low-level signal is received at the first control signal terminal. In these two periods, the low-level signal provided by the first voltage signal terminal is outputted at the emission control signal terminal. When the emission control circuit includes the fifth processing module, the fifth processing module can transmit the first voltage signal to the emission control signal terminal in response to the low-level signal received at the first control signal terminal CK1, so as to pull down the signal outputted at the emission control signal terminal, further guaranteeing that the low-level signal is outputted at the emission control signal terminal in these two periods.

Figure 10:
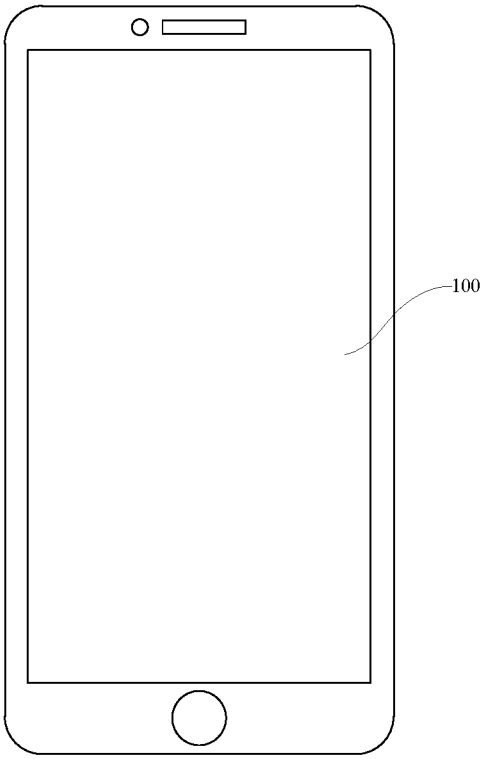
FIG. 10 is a schematic diagram showing a structure of a display device according to an embodiment of the present disclosure.

According to an embodiment of the present disclosure, a display device is provided. As shown in FIG. 10, which is a schematic diagram showing a structure of a display device according to an embodiment of the present disclosure, the display device includes the above emission controller 100. The structure and control method of the emission controller 100 have been described in detail in connection with the above embodiments and details thereof will be omitted here. Of course, the display device shown in FIG. 10 is illustrative only. The display device can be any electronic device having a display function, e.g., a mobile phone, a tablet computer, a notebook computer, an e-paper device or a television.

Since the display device according to the embodiment of the present disclosure includes the above emission controller, it can prevent luminance of sub-pixels from deviating from its standard value, thereby improving display quality.

While the preferred embodiments of the present disclosure have been described above, the scope of the present disclosure is not limited thereto. Various modifications, equivalent alternatives or improvements can be made by those skilled in the art without departing from the scope of the present disclosure. These modifications, equivalent alternatives and improvements are to be encompassed by the scope of the present disclosure.

What is claimed is:

1. An emission controller comprising a plurality of cascaded emission control circuits outputting emission control signals in sequence, wherein each emission control circuit of the plurality of cascaded emission control circuits comprises:

a first processing module electrically connected to a first voltage signal terminal, a start signal terminal and a first control signal terminal, wherein the first processing module is configured to receive a first voltage signal, and provide a first signal to a first node and a second signal to a second node in response to a start signal and a first control signal;

a second processing module electrically connected to a second control signal terminal, wherein the second processing module is configured to provide a third signal to a third node in response to a second control signal and the second signal;

a third processing module electrically connected to a second voltage signal terminal, wherein the third processing module is configured to receive a second voltage signal, and provide a fourth signal to the first node and the third node, the second voltage signal having a higher voltage value of than the first voltage signal;

a fourth processing module electrically connected to a third control signal terminal, wherein the fourth processing module is configured to pull down a signal at the first node in response to a third control signal; and a gating module electrically connected to the first voltage signal terminal, the second voltage signal terminal and an emission control signal terminal, wherein the gating module is configured to receive the first voltage signal and the second voltage signal, and provide an emission control signal to the emission control signal terminal in response to the third signal and the fourth signal, wherein the plurality of cascaded emission control circuits:

the first control signal terminal of a (3n+1)-th emission control circuit of the plurality of cascaded emission control circuits and the second control signal terminal of a (3n+3)-th emission control circuit are each electrically connected to a first clock signal line, the second control signal terminal of the (3n+1)-th emission control circuit of the plurality of cascaded emission control circuits and the first control signal terminal of a (3n+2)-th emission control circuit of the plurality of cascaded emission control circuits are each electrically connected to a second clock signal line, and the second control signal terminal of the (3n+2)-th emission control circuit of the plurality of cascaded emission control circuits and the first control signal terminal of the (3n+3)-th emission control circuit of the plurality of cascaded emission control circuits are each electrically connected to a third clock signal line, wherein n is an integer greater than or equal to 0.

2. The emission controller according to claim 1, wherein the third control signal terminal of the (3n+2)-th emission control circuit of the plurality of cascaded emission control circuits is electrically connected to the first clock signal line, the third control signal terminal of the (3n+3)-th emission control circuit of the plurality of cascaded emission control circuits is electrically connected to the second clock signal line, and the third control signal terminal of the (3n+1)-th emission control circuit of the plurality of cascaded emission control circuits is electrically connected to the third clock signal line.

3. The emission controller according to claim 2, wherein the first clock signal line, the second clock signal line and the third clock signal line output low-level signals in sequence, and when one of the first clock signal line, the second clock signal line and the third clock signal line outputs a low-level signal, the other two each outputs a high-level signal.

4. The emission controller according to claim 1, wherein, the start signal terminal of a $1^{st}$ emission control circuit is electrically connected to a frame start signal line, and among any two neighboring emission control circuits of the plurality of cascaded emission control circuits, the emission control signal terminal of a preceding emission control circuit is electrically connected to the start signal terminal of a following emission control circuit.

5. The emission controller according to claim 1, wherein the first processing module comprises:

a first thin film transistor having its control electrode electrically connected to the first control signal terminal, its first electrode electrically connected to the first node and its second electrode electrically connected to the start signal terminal;

a second thin film transistor having its control electrode electrically connected to the first control signal terminal, its first electrode electrically connected to the second node and its second electrode electrically connected to the first voltage signal terminal; and a third thin film transistor having its control electrode electrically connected to the first electrode of the first thin film transistor, its first electrode electrically connected to the second node and its second electrode electrically connected to the first control signal terminal.

6. The emission controller according to claim 5, wherein the first electrode of the first thin film transistor is electrically connected to the first node via a fourth thin film transistor which is maintained in a switched-on state.

7. The emission controller according to claim 6, wherein the first electrode of the first capacitor is electrically connected to the second node via a seventh thin film transistor, and the seventh thin film transistor is maintained in a switched-on state.

8. The emission controller according to claim 1, wherein the second processing module comprises:

a first capacitor having its first electrode electrically connected to the second node and its second electrode;

a fifth thin film transistor having its control electrode electrically connected to the second node, its first electrode electrically connected to the second electrode of the first capacitor, and its second electrode electrically connected to the second control signal terminal; and a sixth thin film transistor having its control electrode electrically connected to the second control signal terminal, its first electrode electrically connected to the second electrode of the first capacitor, and its second electrode electrically connected to the third node.

9. The emission controller according to claim 1, wherein the third processing module comprises:

an eighth thin film transistor having its control electrode electrically connected to the first node, its first electrode electrically connected to the second voltage signal terminal, and its second electrode electrically connected to the third node; and a ninth thin film transistor having its control electrode electrically connected to the third node, its first electrode electrically connected to the second voltage signal terminal, and its second electrode electrically connected to the first node.

10. The emission controller according to claim 1, wherein the fourth processing module comprises:

a second capacitor having its first electrode electrically connected to the first node and its second electrode electrically connected to the third control signal terminal.

11. The emission controller according to claim 1, wherein the gating module comprises:

a tenth thin film transistor having its control electrode electrically connected to the third node, its first electrode electrically connected to the second control signal terminal, and its second electrode electrically connected to the emission control signal terminal; and an eleventh thin film transistor having its control electrode electrically connected to the first node, its first electrode electrically connected to the emission control signal terminal, and its second electrode electrically connected to the first voltage signal terminal.

12. The emission controller according to claim 11, wherein the fifth processing module comprises:

a twelfth thin film transistor having its control electrode electrically connected to the first control signal terminal, its first electrode electrically connected to the emission control signal terminal, and its second electrode electrically connected to the first voltage signal terminal.

13. The emission controller according to claim 1, wherein each emission control circuit of the plurality of cascaded emission control circuits further comprises:

a fifth processing module electrically connected to the first voltage signal terminal, the first control signal terminal and the emission signal control terminal, and configured to receive the first voltage signal and maintain an output of the first voltage signal to the emission signal control terminal in response to the first control signal.

14. The emission controller according to claim 1, wherein each emission control circuit of the plurality of cascaded emission control circuits further comprises:

a storage capacitor having its first electrode electrically connected to the second voltage signal terminal and its second electrode electrically connected to the third node.

15. A control method for an emission controller, applied in the emission controller comprising a plurality of cascaded emission control circuits outputting emission control signals in sequence, wherein each emission control circuit of the plurality of cascaded emission control circuits comprises:

a first processing module electrically connected to a first voltage signal terminal, a start signal terminal and a first control signal terminal, wherein the first processing module is configured to receive a first voltage signal, and provide a first signal to a first node and a second signal to a second node in response to a start signal and a first control signal;

a second processing module electrically connected to a second control signal terminal, wherein the second processing module is configured to provide a third signal to a third node in response to a second control signal and the second signal;

a third processing module electrically connected to a second voltage signal terminal, wherein the third processing module is configured to receive a second voltage signal, and provide a fourth signal to the first node and the third node, the second voltage signal having a higher voltage value than the first voltage signal;

a fourth processing module electrically connected to a third control signal terminal, wherein the fourth processing module is configured to pull down a signal at the first node in response to a third control signal; and a gating module electrically connected to the first voltage signal terminal, the second voltage signal terminal and an emission control signal terminal, wherein the gating module is configured to receive the first voltage signal and the second voltage signal, and provide an emission control signal to the emission control signal terminal in response to the third signal and the fourth signal, wherein the plurality of cascaded emission control circuits:

the first control signal terminal of a (3n+1)-th emission control circuit of the plurality of cascaded emission control circuits and the second control signal terminal of a (3n+3)-th emission control circuit are each electrically connected to a first clock signal line, the second control signal terminal of the (3n+1)-th emission control circuit of the plurality of cascaded emission control circuits and the first control signal terminal of a (3n+2)-th emission control circuit of the plurality of cascaded emission control circuits are each electrically connected to a second clock signal line, and the second control signal terminal of the (3n+2)-th emission control circuit of the plurality of cascaded emission control circuits and the first control signal terminal of the (3n+3)-th emission control circuit of the plurality of cascaded emission control circuits are each electrically connected to a third clock signal line, wherein n is an integer greater than or equal to 0, wherein the control method comprises:

outputting emission control signals in sequence from each of the plurality of cascaded emission control circuits; and providing low-level signals in sequence at a first clock signal line, a second clock signal line and a third clock signal line, wherein a process of outputting emission control signals in sequence from each of the plurality of cascaded emission control circuits comprises:

in a first period, providing a high-level signal at the start signal terminal; receiving, by the first processing module, the first voltage signal; receiving, by the first control signal terminal, a low-level signal provided at the clock signal line connected to the first control signal terminal; providing the first signal to the first node and the second signal to the second node in response to the low-level signal received at the first control signal terminal and the high-level signal provided at the start signal terminal; outputting, by the emission control signal terminal, a low-level signal, in a second period, receiving, by the second control signal terminal, a low-level signal provided at the clock signal line connected to the second control signal terminal; providing, by the second processing module, the third signal to the third node in response to the low-level signal received at the second control signal terminal; receiving, by the third processing module, the second voltage signal, and providing the fourth signal to the first node; receiving, by the gating module, the first voltage signal and the second voltage signal, and providing a high-level signal to the emission control signal terminal in response to the third signal and the fourth signal, wherein a voltage value of the second voltage signal is greater than a voltage value of the first voltage signal, and in a third period, pulling down, by the fourth processing module, the signal at the first node in response to a low-level signal received at the third control signal terminal; receiving, by the gating module, the first voltage signal and the second voltage signal, and providing a high-level signal to the emission control signal terminal in response to the third signal and the fourth signal.

16. The control method according to claim 15, wherein each emission control circuit of the plurality of cascaded emission control circuits further comprises a fifth processing module, and the process of outputting emission control signals in sequence from each of the plurality of cascaded emission control circuits further comprises:

in an initial time period and the first period, the fifth processing module receives the first voltage signal and maintains output of the first voltage signal to the emission signal control terminal in response to the first control signal.

17. A display device, comprising an emission controller, the emission controller comprising a plurality of cascaded emission control circuits outputting emission control signals in sequence, wherein each emission control circuit of the plurality of cascaded emission control circuits comprises:

a first processing module electrically connected to a first voltage signal terminal, a start signal terminal and a first control signal terminal, wherein the first processing module is configured to receive a first voltage signal, and provide a first signal to a first node and a second signal to a second node in response to a start signal and a first control signal;

a second processing module electrically connected to a second control signal terminal, wherein the second processing module is configured to provide a third signal to a third node in response to a second control signal and the second signal;

a third processing module electrically connected to a second voltage signal terminal, wherein the third processing module is configured to receive a second voltage signal, and provide a fourth signal to the first node and the third node, the second voltage signal having a higher voltage value than the first voltage signal;

a fourth processing module electrically connected to a third control signal terminal, wherein the fourth processing module is configured to pull down a signal at the first node in response to a third control signal; and a gating module electrically connected to the first voltage signal terminal, the second voltage signal terminal and an emission control signal terminal, wherein the gating module is configured to receive the first voltage signal and the second voltage signal, and provide an emission control signal to the emission control signal terminal in response to the third signal and the fourth signal, wherein the plurality of cascaded emission control circuits:

the first control signal terminal of a (3n+1)-th emission control circuit of the plurality of cascaded emission control circuits and the second control signal terminal of a (3n+3)-th emission control circuit are each electrically connected to a first clock signal line, the second control signal terminal of the (3n+1)-th emission control circuit of the plurality of cascaded emission control circuits and the first control signal terminal of a (3n+2)-th emission control circuit of the plurality of cascaded emission control circuits are each electrically connected to a second clock signal line, and the second control signal terminal of the (3n+2)-th emission control circuit of the plurality of cascaded emission control circuits and the first control signal terminal of the (3n+3)-th emission control circuit of the plurality of cascaded emission control circuits are each electrically connected to a third clock signal line, wherein n is an integer greater than or equal to 0.

18. The display device according to claim 17, wherein among the plurality of cascaded emission control circuits:

the third control signal terminal of the (3n+2)-th emission control circuit of the plurality of cascaded emission control circuits is electrically connected to the first clock signal line, the third control signal terminal of the (3n+3)-th emission control circuit of the plurality of cascaded emission control circuits is electrically connected to the second clock signal line, and the third control signal terminal of the (3n+1)-th emission control circuit of the plurality of cascaded emission control circuits is electrically connected to the third clock signal line.

19. The display device according to claim 17, wherein among the plurality of cascaded emission control circuits, the start signal terminal of a $1^{st}$ emission control circuit is electrically connected to a frame start signal line, and among any two neighboring emission control circuits of the plurality of cascaded emission control circuits, the emission control signal terminal of a preceding emission control circuit is electrically connected to the start signal terminal of a following emission control circuit.

20. The display device according to claim 17, wherein each emission control circuit of the plurality of cascaded emission control circuits further comprises:

a fifth processing module electrically connected to the first voltage signal terminal, the first control signal terminal and the emission signal control terminal, and configured to receive the first voltage signal and maintain output of the first voltage signal to the emission signal control terminal in response to the first control signal.

* * * * *